US006045450A

United States Patent [19]

Cyr

[11] Patent Number: 6,045,450

[45] Date of Patent: Apr. 4, 2000

[54] BILLIARDS TABLE TARGETING DISK

[75] Inventor: Raymond L. Cyr, Arlington, Mass.

[73] Assignee: Contemporary Marketing & Design Group, Inc., Fox Point, Wis.

[21] Appl. No.: 09/173,896

[22] Filed: Oct. 16, 1998

[51] Int. Cl.[7] ..... A63D 15/00; G01C 15/00

[52] U.S. Cl. ..... 473/2; 33/289

[58] Field of Search ..... 473/2, FOR 2, 473/1, 405, 406, 407; 33/289, 471, 508

[56] References Cited

U.S. PATENT DOCUMENTS

| | | |
|---|---|---|
| 3,411,779 | 11/1968 | McGowan . |
| 3,463,593 | 8/1969 | Horan . |
| 3,704,887 | 12/1972 | Thorton . |
| 3,843,120 | 10/1974 | Ricci . |
| 3,947,026 | 3/1976 | Scoutten . |
| 4,151,990 | 5/1979 | Josenhans . |
| 4,178,694 | 12/1979 | Bonney . |
| 5,154,415 | 10/1992 | Zotos . |
| 5,401,215 | 3/1995 | Pfost . |

FOREIGN PATENT DOCUMENTS

| | | | |
|---|---|---|---|
| 26076 | 5/1913 | United Kingdom | 473/2 |
| 323795 | 1/1930 | United Kingdom | 473/2 |
| 325521 | 2/1930 | United Kingdom | 473/2 |
| 2 152 390 | 8/1985 | United Kingdom | 473/2 |
| 2 238 481 | 6/1991 | United Kingdom | 473/2 |

OTHER PUBLICATIONS

The Ghostball Aim Trainer developed by Elephant Balls, Ltd. of Columbus, Ohio. (no date), (Admitted prior art).

*Primary Examiner*—Sebastiano Passaniti

*Attorney, Agent, or Firm*—Sokol Law Offices; Jeffrey S. Sokol

[57] ABSTRACT

This invention relates to a targeting disk that lays flat on a billiards table and enables a player to more reliably aim and shoot a cue ball at a target ball. The disk has a hemispherical or half-moon shape that is twice as wide as it is long. The radius of the disk is about equal to the combined radii of the cue and target ball. An upper surface of the disk includes a targeting indicium for aiming the cue ball, an alignment pattern and notch for aligning the disk under the target ball, and a pointer for aiming the disk at an intended target such as a pocket or another ball on the table. The targeting indicium is located on an edge of the disk so that the cue ball can strike the target ball without rolling across the surface of the disk. The alignment notch is circular in shape and sized to provide a visual aid that compliments the alignment ring for aligning the targeting disk under the target ball. The hemispherical shape creates two aiming wings located away from the pointer so that the player can easily handle the disk without obstructing his or her view of a pointer. The disk is made of a durable vinyl material with a relatively rigid composition for easy handling and increased life. The upper surface is roughened to enable the cue ball to grip the surface of the disk better than other conventional targeting devices.

14 Claims, 5 Drawing Sheets

BILLIARDS TABLE TARGETING DISK

TECHNICAL FIELD OF THE INVENTION

This invention relates to a targeting disk that lays flat on a billiards table and is aligned under a target ball to provide a target at which a cue ball is aimed in order to strike the target ball at a specific point and propel the ball toward a pocket in the table.

BACKGROUND OF THE INVENTION

Devices for learning to play billiards are known in the art. An example of such a device is shown in U.S. Pat. No. 3,843,120, the disclosure of which is incorporated herein. Targeting devices help players recognize the proper point on a target ball to strike with a cue ball to propel the target ball toward a target or pocket in the table. Some targeting devices lie flat on the billiards table so that the cue ball and target balls can roll over the surface of the targeting device. Targeting devices of this type are illustrated in FIGS. 1 and 2.

The targeting device shown in FIG. 1 has an oval shape that is twice as long as it is wide. The width of 2¼ inches is equal to the diameter of a standard target ball. The length of 4½ inches is equal to the combined diameters of the target ball and a standard cue ball. It should be noted that many billiards tables are designed to use a cue ball that is slightly smaller in diameter than the target balls. The targeting device is made of plastic and has a thickness of about 0.010 mils. The upper and lower surfaces of the device are flat with a relatively smooth finish. The upper surface depicts an area for holding the target ball, an area for aiming the cue ball and an arrow for pointing it at the intended target.

The holding area includes a 2¼ inch diameter alignment ring that extends from one side or edge of the targeting device to the other. When viewed from above, the perimeter of the target ball should line-up with the ring. The player can use the ring to align the target ball over a small ¼ inch diameter centering hole located at the center of the alignment ring. The hole receives the target ball and further aligns it on the upper surface of the targeting device. The small size of the hole renders it difficult to see when the ball is placed over it. The ball engages and rests on the sides of the hole. The engagement of the ball with the sides of the hole causes the ball to slide or roll into the hole so that a central axis of the ball is aligned through a center of the hole. The weight of the ball also depresses the targeting device into the felt surface of the table, as discussed below.

The aiming area includes a 2¼ inch diameter aiming ring that abuts the alignment ring. The aiming ring also extends from one side or edge of the targeting device to the other. A bullseye is depicted at a center of the aiming ring. The center of the bullseye is located 2¼ inches from the center of the centering hole. This distance is equal to the combined radii of the standard target and cue balls. The aiming area also depicts several lines or aiming guides that fan out from the bullseye. These lines are intended to aid the player in determining the direction the cue ball will travel after striking the target ball.

The arrow is depicted by two spaced apart lines that form a shaft of the arrow and two triangles that form a head of the arrow. The shaft extends from the bullseye to the centering hole. The arrowhead is located in an outer half of the holding area. When the targeting device is placed on the table, the arrow is aligned to point at the intended target. The target ball is then placed on the centering hole. In theory, when the player aims the cue ball at the bullseye, the cue ball should strike the target ball at the correct point and propel the target ball in the direction of the arrow.

FIG. 2 shows a similar targeting device with the outer half of the holding area and the arrowhead removed. The targeting device is 2¼ inches wide and 3⅜ inches long. The targeting device does not contain a centering hole and the ball does not rest on the holding area. Instead, a V-shaped notch is provided to accommodate an area of the ball just above the felt surface of the table. The V-shaped notch allows the player to place the targeting device under the target ball without lifting the ball. The player slides the notch under the target ball until it stops or the notch is snug against the ball. The notch is intended to assist the player in aligning the bullseye a proper distance from the ball.

One problem with conventional targeting devices is that the bullseye is located at the center of the aiming area. The cue ball must travel across and roll over half the surface of the aiming area before striking the target ball. This can compromise the intended path of the cue ball before it strikes the target ball. Under normal playing conditions, the weight of the cue and target balls compress and sink slightly into the soft felt surface of the table. The targeting device is relatively light in weight, does not compress the felt and lays flat on the surface of the table. The cue ball must ride up onto the elevated surface of the targeting device and travel across its surface before striking the target ball. Although the targeting device is relatively thin, the cue ball must still lift out of its depression in the felt and up onto the surface of the targeting device. This riding up or lifting of the cue ball can cause it to move off path or alter its speed. Any change in path of the cue ball caused by the targeting device is accentuated by the distance the cue ball has to travel across the device before striking the target ball. The farther the cue ball moves along its altered path before striking the target ball, the farther away the cue ball will be from the correct point when it strikes the target ball. The further the cue ball move across the disk to get to the intended point of contact with the target ball, the less reliable the device is as an aid for making shots.

Another problem with conventional targeting devices is that the cue ball does not grip the smooth surfaces of the device to the degree it grips the soft felt surface of the table. The change in gripping action can cause the cue ball to slip on the targeting device, which can alter its path of travel. The change in gripping can also cause the cue ball to spin or roll differently when traveling across the targeting device. The change in path of travel and spin of the cue ball are particularly relevant when back, top or side spin, otherwise known as English, is applied to the cue ball. Again, the further the distance the cue ball travels across the targeting device, the greater the change in path or spin of the cue ball before it strikes the target ball, and the less reliable the device is as an aid for making shots.

A further problem with conventional targeting devices is that they can be difficult to handle when aligning them under the target ball. No area is provided for handling the device when sliding it under the target ball and rotating the arrow at the target. The relatively narrow width of the device encourages a player to handle it near its center which can obstruct the player's view of the arrow or shaft, and result in a misalignment of the device.

A still further problem with conventional targeting devices is that in many shot situations the devices do not provide a reliable visual aid for aligning it under the target ball. For example, when the target ball is located near the center of the table, the player is unable to view the ball from directly above to align the perimeter of the ball with the alignment ring. Children may be unable to perform this task no matter where the target ball is located on the table. In addition, the V-shaped notch of the device shown in FIG. 2 does not correspond to the size and circular shape of the ball, and does not provide a good visual aid for aligning the device. This renders the device difficult to align in many game situations.

A still further problem with conventional targeting devices is that the notch does not provide a reliable structure for accurately aligning the device under the target ball. The V-shaped notch shown in FIG. 2 does not physically correspond to the shape of the ball just above the surface of the table. The V-shaped notch has straight sides that engage a single point or part of the curved shape of the ball. This reduces the amount of contact area between the sides of the notch and the surface of the ball when snugging the device against the ball. The reduction in contact area reduces the amount of feel the player has when snugging the device into place. The player may think he or she is snugging the device the same amount each time, but is actually positioning the bullseye a different distance from the ball for each shot. This lack of consistency in aligning the device with the ball renders it less useful as a reliable aid for making shots.

Another problem with some conventional targeting devices is that they require the player to lift the target ball and place it on the targeting device. This not only disrupts the game, but requires the target ball to travel across the surface of the targeting device before making contact with the felt surface of the table. For the reasons stated above, this contact can compromise the intended path, spin or speed of the ball.

Another problem with conventional targeting devices is that they have a relatively thin and flimsy construction. This flimsy construction renders it difficult to align under the target ball without inadvertently hitting and moving the target ball, and disrupting the course of play.

Another problem with conventional targeting devices is that the bullseye can be difficult to focus on because it is surrounded by other markings. The bullseye in the device shown in FIGS. 1 and 2 is surrounded by a number of fan-like lines that can confuse a novice player. These types of distractions can be particularly annoying in a dimly lit or smoke filled room.

The various features of the present invention overcome all of these problems.

SUMMARY OF THE INVENTION

This invention relates to a targeting disk that lays flat on a billiards table and enables a player to more reliably aim and shoot a cue ball at a billiards or target ball. The disk has a hemispherical or half-moon shape that is twice as wide as it is long. The radius of the disk is equal to the combined radii of the cue ball and target ball. An upper surface of the disk includes a targeting indicium for aiming the cue ball, an alignment pattern and notch for aligning the disk under the target ball, and a pointer for aiming the disk at an intended target such as a pocket in the table or another billiards ball. The targeting indicium is located on an edge of the disk so that the cue ball can strike the target ball without first rolling across the surface of the disk. The alignment notch is circular in shape and sized to provide a visual and physical aid that compliments the alignment ring for aligning the targeting disk under the target ball. The hemispherical shape creates two aiming wings located away from the pointer so that the player can easily handle the disk without obstructing his or her view of a pointer. The disk is made of a durable vinyl material with a relatively rigid composition for easy handling and increased life. The upper surface is roughened to enable the cue ball ball to grip the surface of the disk better than other conventional targeting devices.

One advantage of the present targeting disk is that the size and hemispherical shape of the disk and the orientation of the targeting indicium on the edge of the disk provide a structure that enables the cue ball to strike or contact the target ball virtually simultaneously with its engagement with the disk. Any disruption in the path of the cue ball caused by the disk is minimized or non-existent because the cue ball does not have time to veer off course. Any change in the path of the cue ball does not cause it to strike the target ball at a point significantly different from the proper point to propel the target ball along the intended path towards the intended target. Accordingly, the present targeting disk results in improved reliability and accuracy as an aid for making shots.

Another advantage of the present targeting disk is that any change in the path or spin of the cue ball caused by the change in gripping action when the ball rolls onto the disk is minimized because the cue ball strikes the target ball virtually simultaneously with its engagement with the disk. Again, the cue ball does not have sufficient time to react to the change in gripping action to cause any significant change in path or spin of the cue ball.

A further advantage of the present targeting disk is that its hemispherical or half moon shape creates two opposed aiming wings outside of the targeting and alignment patterns and away from the pointer located towards the center of the disk. These aiming wings allow a player to more easily position and align the targeting disk next to a selected target ball without blocking their view of the pointer. This enables the player to more readily align the disk in the correct direction for making the shot.

A still further advantage of the present targeting device is that in many shot situations the aiming wings are located outside of the path of travel of the cue ball after it strikes the target ball. The location of the aiming wings allows the player to practice leaving the cue ball, otherwise known as a "leave", in a predetermined position after the shot without much interference from the targeting disk.

Another advantage of the present targeting device is that the size and shape of its alignment notch provides a structure for more reliably and consistently snugging the disk under the target ball. The alignment notch has a hemispherical or half-moon shape with a semi-circular side or edge. As stated above, the weight of the target ball causes it to sink into or depress the felt surface of the table. This depression causes a saucer shaped area of the ball to come into contact with the table. The radius of the notch is roughly the same as a radius of a circular cross sectional area of the ball just above the surface of the table. When the disk is placed flat on the table and slide against the ball, the side of the hemispherical alignment notch is flush with the surface of the ball just above the surface of the table. The hemispherical shaped notch engages a large hemispherical area of the ball when it is being snugged between the ball and the surface of the table. This large engagement or snugging area along the curved side of the notch translates into greater resistance as the disk initially engages the ball and is snugged in place. This increased resistance provides the player with a better degree of feel when attempting to snug the disk the same distance under the ball each time. The improved feel enables the player to more reliably position the center of the targeting indicium the appropriate distance from the central axis of the ball each time. As a result, the disk is a more consistent and reliable targeting aid than other conventional targeting devices.

A still further advantage of the present targeting disk is that the alignment notch provides a complimentary visual aid to the alignment ring for aligning the targeting disk under the target ball. In instances where the player is unable to view the target ball from above, such as when the ball is located toward the middle of the table, the player cannot reliably align the perimeter of the ball with the alignment ring. In these situations, the player can use the hemispherical alignment notch to ensure that the center of the notch and disk are being aligned with the central axis of the target ball. This is done by viewing the ball from the side, which can be readily accomplished when the ball is in the middle of the table. By aligning the contour of the circular edge of the alignment notch with the circular side of the target ball just above the surface of the table, the player is provided with a visual aid for aligning the center of the disk with the center of the ball. Proper alignment is readily achieved even when the ball is located in the middle of the table.

Another advantage of the present targeting disk is that it allows easy rotation of the disk around the target ball to align the pointer at the intended target. When snugged under the target ball, a player can easily rotate the disk around the ball by pushing the side of the targeting indicium in a direction perpendicular to the pointer. The targeting indicium is easy to push because it extends outwardly from the otherwise smoothly curved edge of the disk. The disk pivots about the target ball and easily rotates to point in the desired direction. This ease in aiming the pointer provides a user-friendly product and enables more consistent and accurate use of the disk.

Another advantage of the present targeting disk is that it enables the ball to grip the disk better than conventional targeting devices. The targeting disk is made of a vinyl material having an upper surface with a roughened texture. The roughened texture helps reduce the change in gripping as the cue ball leaves the felt table and moves onto the disk. The reduction in the change of gripping helps prevent the cue ball from changing its path of travel and spin in shot situations where the player desires the cue or another ball to cross the surface of the disk.

Another advantage of the present targeting disk is its relatively stiff construction. The targeting disk is made from a vinyl material that gives it a relatively stiff and rigid composition. This rigidity helps ensure that the targeting disk remains flat during the alignment process. The rigid construction also aids in handling the targeting disk because it does not easily catch on the felt surface and slides smoothly into alignment reducing the possibility of inadvertently moving the target ball.

Another advantage of the present invention is the simplicity of the visual design of the targeting indicium. This coloration ensures that a player can easily see the targeting indicium when lining up the cue ball. The absence of confusing angle lines fanning out from the targeting indicium assists novice players in understanding the proper shot. This is particularly helpful when a game is being played in a dark or smoke filled room.

Other features and advantages of the invention will be apparent from the following specification taken in conjunction with the following drawings.

DETAILED DESCRIPTION

Figure 1:
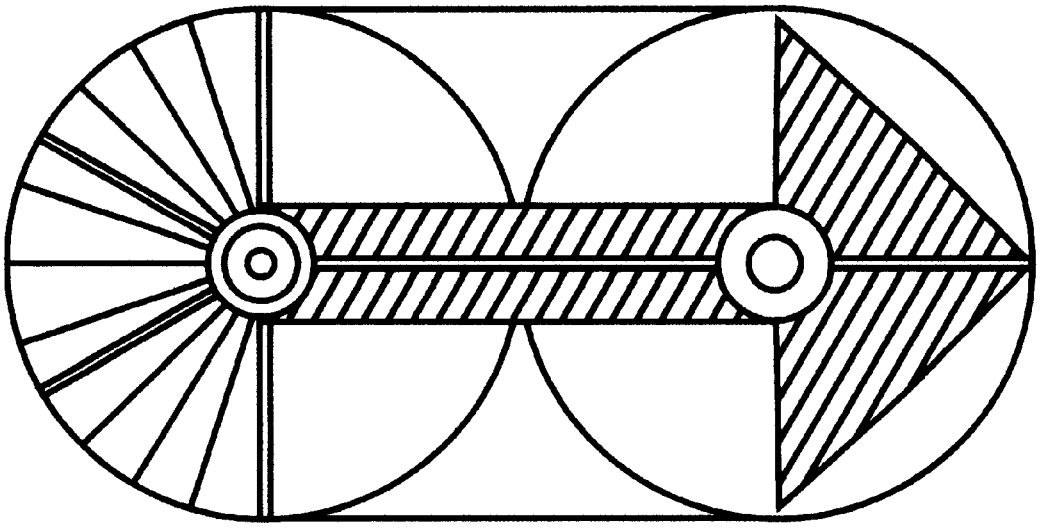
Fig. 1 Prior Art
FIG. 1 is a top view of a conventional billiards targeting device.
Figure 2:
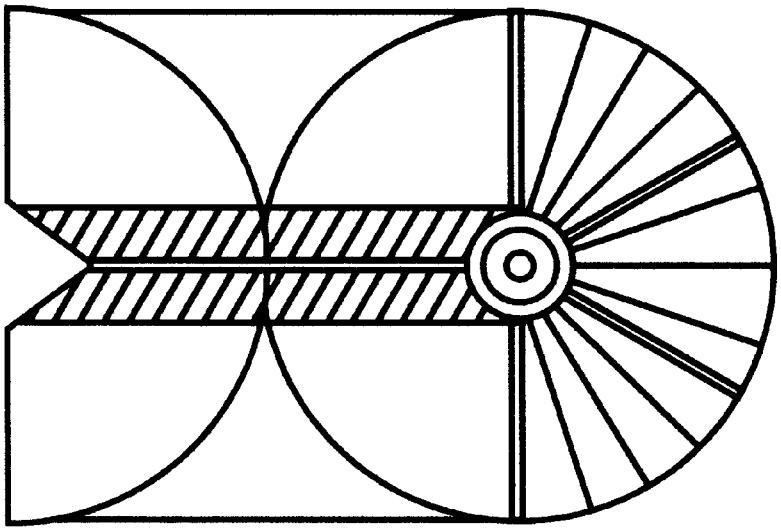
Fig. 2 Prior Art
FIG. 2 is a top view of another conventional billiards targeting device.

While this invention is susceptible of embodiments in many different forms, there is shown in the drawings, and will herein be described, a preferred embodiment of the invention with the understanding that the present disclosure is to be considered as an exemplification of the principles of the invention and is not intended to limit the broad aspects of the invention to the embodiment illustrated.

Figure 3:
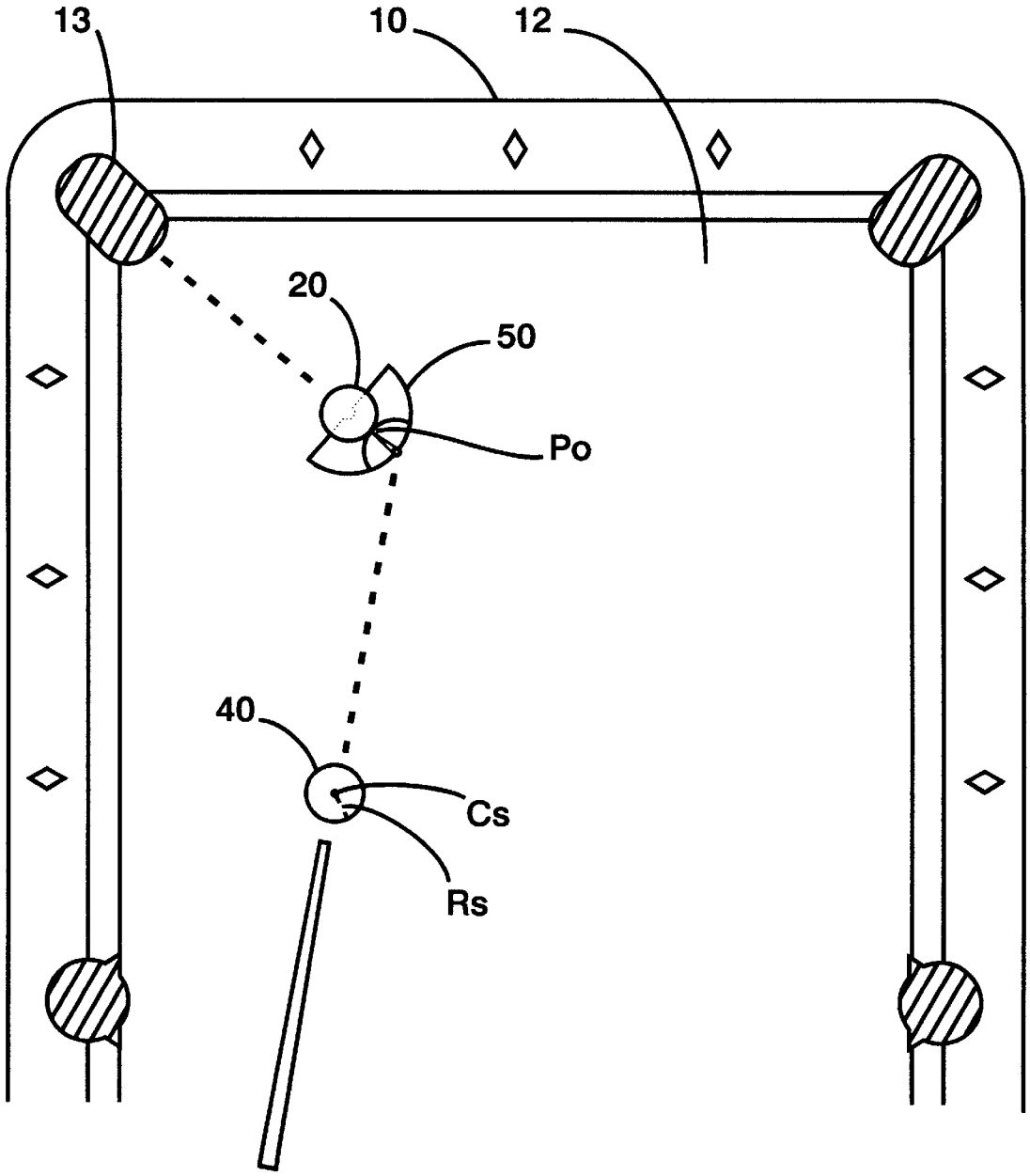
FIG. 3 is a view of a billiards table with the targeting disk aligned with a target ball and aimed at a pocket in the corner of the table, and with a cue ball aimed at a targeting indicium on the disk.
Figure 4:
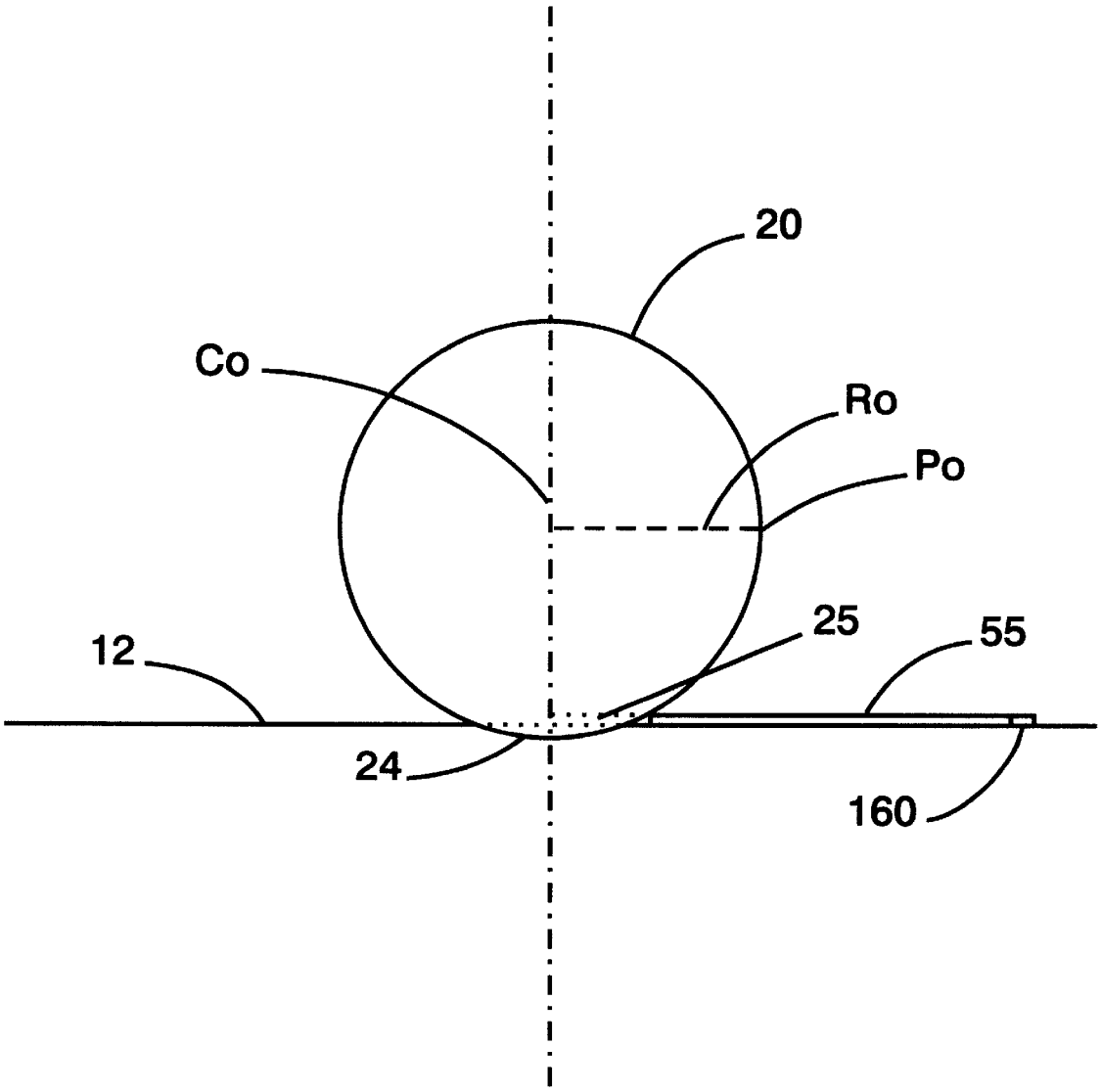
FIG. 4 is a side sectional view showing a target ball depressing the felt surface of the table and the targeting disk aligned under and snugged against the ball.

The present invention is generally intended for use with a billiards table 10 having a felt surface 12 and several targets or pockets 13 as shown in FIG. 3. The table includes several target or object balls 20 with central axes Co and radii Ro, and a cue ball or striking ball 40 with a central axis Cs and a radius Rs. As best shown in FIG. 4, the weight of the object ball 20 causes it to sink into or depress the soft felt surface of the billiards table 12. When resting in the depression, a saucer shaped area 24 of the object ball 20 comes into contact with the felt surface 12. The object ball has a cross sectional area 25 located just above the felt surface 12 and the saucer shaped area 24. The cross sectional area 25 has a radius Rc.

In order to propel the object ball in a predetermined path towards the target 13, a player must strike a proper point Po on the object ball 20 with the striking ball 40. As shown in FIGS. 3 and 4, the proper point Po is located on the surface of the object ball 20 and is in direct linear alignment with a center of the object ball 20 and the target 13. It should be understood that the proper point Po is located at different points of the object ball 20 depending on the position of the object ball 20 in relation to the intended target 13.

Figure 5:
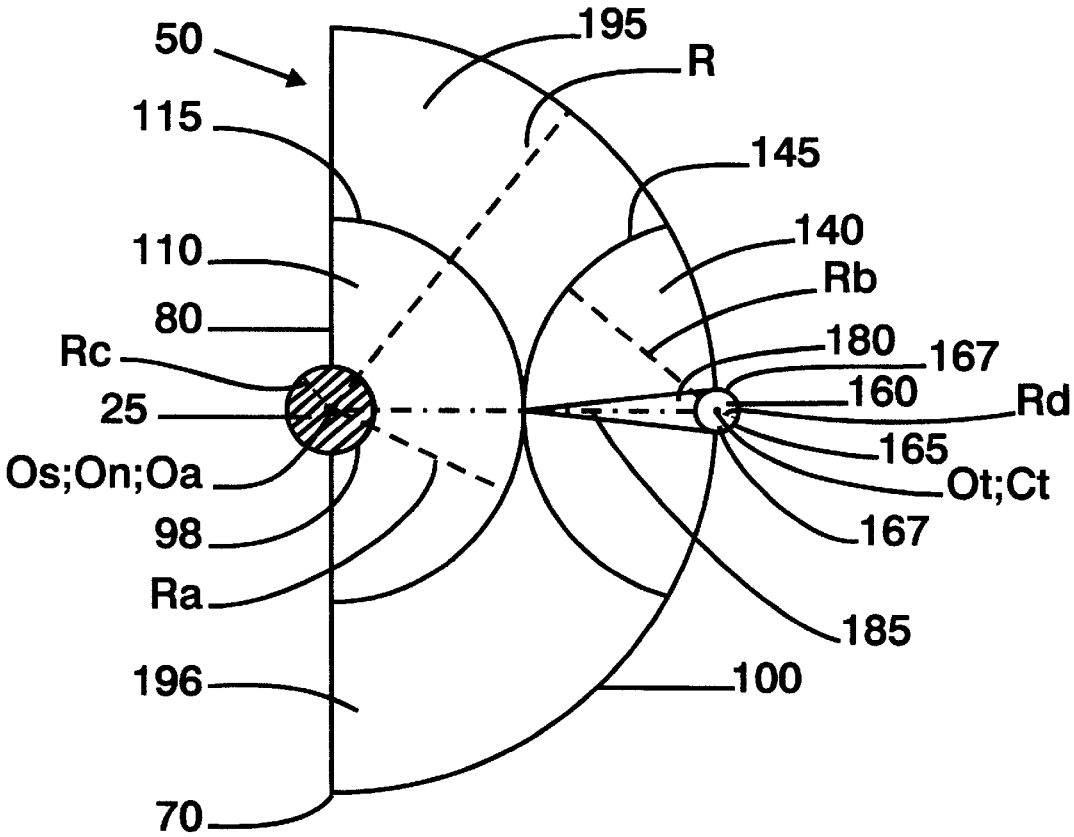
FIG. 5 is a top view of the present billiards targeting disk showing the orientation of the alignment and targeting patterns, pointer, and targeting indicium and alignment notch.
Figure 6:
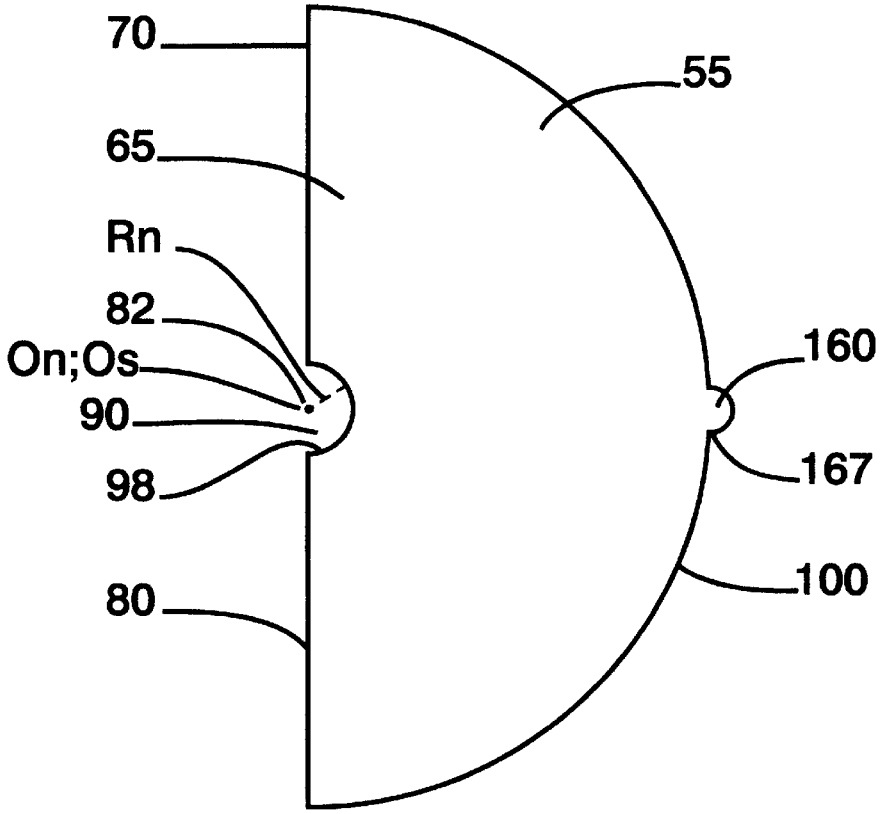
FIG. 6 is a bottom view of the present targeting disk.
Figure 7:
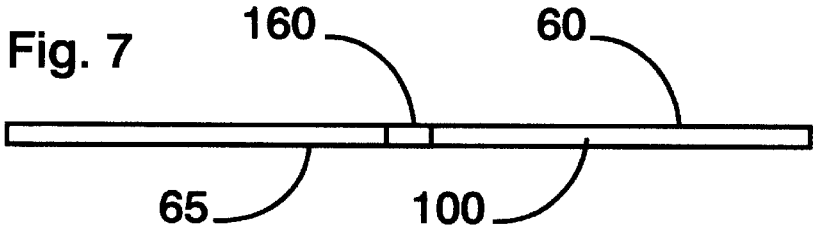
FIG. 7 is a side plan view showing a back edge of the targeting disk.
Figure 8:
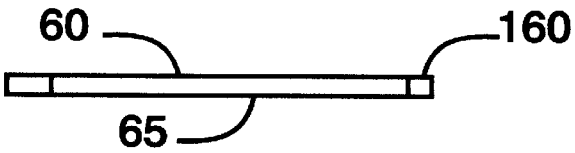
FIG. 8 is a side plan view showing a side edge of the targeting disk.
Figure 9:
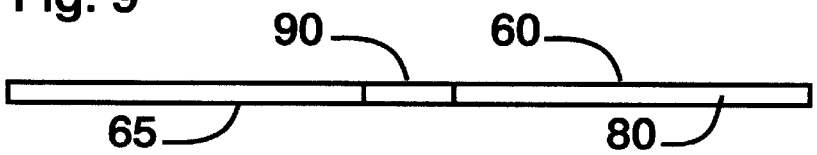
FIG. 9 is a side plan view showing the front edge of the targeting disk.

The present invention is a billiards targeting disk that is generally indicated by reference number 50. The targeting disk 50 has a substantially hemispherical or half-moon shaped, vinyl substrate 55. The vinyl substrate 55 comprises a roughened, scratch resistant upper surface 60 and a smooth lower surface 65. The upper and lower surfaces 60 and 65 are planer and substantially parallel. The substrate has a thickness of 0.010 mils or less and is relatively stiff in construction compared to conventional targeting devices. As best shown in FIG. 5, the smooth lower surface 65 is adapted to rest on and easily slide across the soft felt surface 12 of the billiards table 10.

The targeting disk 50 has a perimeter 70 formed by a straight alignment edge 80 with a notch 90 and a continuously arcing targeting edge 100. The alignment edge 80 is adapted to rest proximal the target or object ball 20. The alignment edge 80 has an alignment midpoint 82. As best shown in FIG. 4, the alignment notch 90 has a radius Rn that is sized and configured to permit it to snug against the outer perimeter of the cross sectional area 25 of the object ball 20. The alignment notch 90 is arcuately shaped and has a circular shaped edge 95 providing a continuous snugging area 98 for engaging the cross sectional area 25 of the object ball 20. The alignment notch 90 has an origin On located on the midpoint 82.

During the alignment process, the alignment notch 90 is placed flush against the object ball 20 so that the continuous snugging area 98 engages a large hemispherical portion of the ball 20 proximal the cross sectional area 25 just above the surface 12 of the table 10. The radius Rn of the alignment notch 90 ensures continuous contact between the snugging area 98 and the cross sectional area 25 of the object ball 20, and facilitates positioning of the central axis Co of the object ball 20 over the alignment midpoint 82. The continuous contact of the disk 50 when initially engaging the object ball 20 provides an increased amount of feel a player has when aligning the targeting disk 50. The increased feel provides greater consistency in aligning the central axis Co of the object ball 20 over the alignment midpoint 82. Also, the arcuate configuration of the alignment notch 90 provides a visual aid for aligning the alignment midpoint 82 under the central axis Co of the object ball 20. The configuration of the notch 90 further allows the targeting disk 50 to pivot or rotate about the object ball 20 while the snugging area 98 maintains continuous contact with the object ball 20.

The targeting disk 50 has a circular alignment pattern 110 on the upper surface 60 of the substrate 55. As shown in FIG. 5, the alignment pattern 110 has a partially circular border 115 that defines an alignment origin Oa. The alignment origin Oa falls on the midpoint 82 of the alignment edge 80. The alignment pattern 110 has a radius Ra corresponding to radius Ro of the object ball 20. When viewed from above, the alignment pattern 110 aids the player in properly aligning the targeting disk 50 with the object ball 20, so that the alignment origin Oa coincides with the central axis Co of the target or object ball 20.

As shown in FIG. 5, the targeting disk 50 has a targeting pattern 140 on the upper surface 60 of the substrate 55. The targeting pattern 140 has a circular border 145 that defines a targeting origin Ot. The targeting origin Ot is located on the arc forming the targeting edge 100. The targeting pattern 140 has a radius Rb corresponding to the radius Rs of the striking or cue ball 40. As a result of the hemispherical shape of the substrate 55, the targeting pattern 140 is less than half a full circle.

The disk 50 includes a targeting indicium 160 that has a center Ct that coincides with the targeting origin Ot. The targeting indicium 160 abuts the targeting edge 100. As best shown in FIG. 5, the targeting indicium 160 is defined by a circular indicium edge 165 with a radius Rd of about ⅛ inch. The indicium edge 165 forms a part of the targeting edge 100. As shown in FIG. 4, a portion of the targeting indicium 160 extends outwardly from the otherwise smooth arcuate targeting edge 100 to form a perpendicular edge 167. A player can push against the perpendicular edge 167 to pivot or rotate the targeting disk 50 about the central axis Co of the object ball 20 when the snugging area 98 engages the cross sectional area 25. The relatively small targeting indicium 160 is located sufficiently close to the targeting edge 100 which enables the striking ball 40 to virtually simultaneously strike the object ball 20 as it contacts the targeting disk 50.

The targeting disk 50 has a pointer 180 extending from the targeting indicium 160 towards the alignment origin Oa. The pointer 180 has a length corresponding to the radius Rb of the targeting pattern 140. The pointer 180 is in straight alignment with and forms a line between the alignment origin Oa and the targeting origin Ot. The pointer 180 also is located on a line of symmetry 185 extending between the alignment origin Oa and the targeting origin Ot. The line of symmetry 185 divides the targeting disk 50 into two symmetrical halves. As best shown in FIG. 3, the proper point Po for striking the object ball 20 is located directly above the pointer 180 and the line of symmetry 185.

The targeting disk 50 has aiming wings 195 and 196. The aiming wings 195 and 196 are located away from the alignment origin Oa a distance greater than the radius Ra of the alignment pattern 110. The aiming wings 195 and 196 allow a player to hold or slide the targeting device 50 with one or two hands when engaging the object ball 20 and pivot or rotate the targeting disk 50 about the object ball 20 when aligning the pointer 180.

Polar Coordinates

Though the use and configuration of the present invention should be readily apparent from the contents of the above description, the following description is provided to define the targeting disk 50 from a different point of reference. Given the arcuate configuration of the targeting disk 50, the following describes the invention through the use of polar coordinates to assist the reader in understanding the configuration and orientation of the targeting disk 50 and its components.

The substantially hemispherical disk 50 has a radius R and an origin Os located at point (0,0). The hemispherical disk 50 spans from r=(0 to R) and ø=(0 through 180°), where r is the distance from the origin Os and ø is the degree of rotation about the origin. The arc r=R and ø=(0 through 180°) defines the targeting edge 100. The points r=(0 to R) and ø=(0 and 180°) define the alignment edge 80. The location of the alignment origin Oa coincides with origin Os at point (0,0).

The alignment notch 90 has a circular shaped edge with the radius Rn. The configuration of the alignment notch 90 corresponds to the radius Rc of the cross sectional area 25 of the object ball 20. The alignment notch 90 originates from the origin On and spans from r=(0 to Rn) and ø=(0 through 180°). The origin On coincides with the alignment origin Oa at point (0,0).

The alignment pattern 110 has a radius Ra and and a circular alignment border 115. The circular alignment border 115 of the alignment pattern 110 defines the alignment origin Oa at point (0,0). The alignment pattern 110 spans from r=(0 to Ra) and ø=(0 through 180°). The alignment border 115 extends from points Ra and ø=(0 through 180°).

The center point Ct of the targeting indicium 160 is located on the targeting origin Ot at point (R, 90°). The targeting indicium 160 has a radius Rd. The targeting indicium 160 originates from the targeting origin Ot and spans from r=(0 to Rd) and ø=(0 through 360°). The indicium edge 165 of the targeting indicium 160 extends along the arc having origin Ot and extending through points Rd and ø=(0 through 180°).

The targeting pattern 140 has a circular targeting border 145 that defines the targeting origin Ot. The targeting border 145 extends from points along an arc having origin Ot and extending through r=Rb and ø=(180° through 360°). The targeting pattern 140 originates from the targeting origin Ot and spans from r=(0 to Rb) and ø=(180° through 360°).

The pointer 180 is aligned with the alignment origin Oa and the targeting origin Ot. The pointer 180 forms a ray originating from the targeting origin Ot extending towards the alignment origin Oa along ø=270°. The pointer 180 has a length corresponding to radius Rs of the cue ball 40.

It will be understood that the invention may be embodied in other, specific forms without departing from the spirit or central characteristics thereof. The present examples and embodiments, therefore, are to be considered in all respects as preferred, specific aspects of the invention and not restrictive as to the broader aspects of the invention.

I claim:

1. A billiards targeting disk for use with a billiards table having a supporting surface and at least one target, the billiard table including an object ball and a striking ball that rest on the supporting surface, the object ball having a central axis Co and radius Ro and the striking ball having a central axis Cs and radius Rs, said targeting disk comprising;

a thin substrate having upper and lower surfaces and a perimeter, said upper and lower surfaces being planar and substantially parallel, said lower surface being adapted to lay flat on the supporting surface;

an alignment pattern visible from said upper surface of said substrate, said alignment pattern having a border that defines an alignment origin Oa and a radius Ra corresponding to the radius Ro of the object ball, said alignment pattern providing a visual aid for aligning said alignment origin Oa under the central axis Co of the object ball;

an alignment edge defining a first portion of said perimeter of said substrate, said alignment edge being proximal said alignment pattern;

a targeting edge defining a second portion of said perimeter of said substrate; and, a targeting indicium visible from said upper surface of said substrate, said targeting indicium being located sufficiently close to said targeting edge to enable the striking ball to substantially simultaneously strike the object ball as it engages said targeting disk.

2. The billiards targeting disk of claim 1, and wherein said targeting indicium has an edge that forms a part of said alignment edge.

3. The billiards targeting disk of claim 1, and wherein said targeting disk has a substantially hemispherical shape.

4. The billiards targeting disk of claim 3, and wherein said substantially hemispherical shape has a radius R substantially equal to the combined radii of the object ball Ro and striking ball Rs.

5. The billiards targeting disk of claim 4, and wherein said targeting edge forms a continuous arc, and said targeting indicium extends outwardly from said continuous arc to form a perpendicular edge, the targeting disk being adapted to allow the player to push against said perpendicular edge to rotate the disk about the object ball and aiming the disk at the target.

6. The billiards targeting disk of claim 5, and wherein said targeting indicium has a center Ct and said hemispherically shaped targeting disk has a line of symmetry extending through said alignment origin Oa and said center Ct, and said hemispherically shaped targeting disk has two opposed aiming wings located more than a distance equal to said radius Ra from said line of symmetry.

7. The billiards targeting disk of claim 1, and wherein the object ball has a cross sectional area just above the surface of the table with a radius Rc, and wherein said alignment edge has an alignment notch with a circular shaped edge with a radius substantially equal to Rc, said circular shaped edge providing a continuous snugging area for engaging the ball just above the surface of the table.

8. The billiards targeting disk of claim 7, and wherein said circular shaped edge provides a visual aid for aligning the disk with the central axis Co of the object ball.

9. The billiards targeting disk of claim 1, and further comprising a pointer visible from said upper surface of said substrate, said targeting indicium having a center Ct, and said pointer being linearly aligned with said center Ct and said alignment origin Oa, said disk being adapted that when said alignment origin Oa is aligned under the central axis Co of the object ball and said pointer is aimed at the target, the player can aim the central axis Cs of the striking ball at said center Ct of said targeting indicium to cause the striking ball to strike a proper point Po on the object ball to propel the object ball toward the target.

10. The billiards targeting disk of claim 1, and further comprising a targeting pattern visible from said upper surface of said substrate, said targeting pattern having a circular border that defines a targeting origin Ot and a radius Rb corresponding to the radius Rs of the striking ball, said center Ct of said targeting indicium being located on said targeting origin Ot.

11. A billiards targeting disk for use with a billiards table having a supporting surface and at least one target, an object ball and a striking ball, the object ball having central axis Co and a radius Ro and the striking ball having a central axis Cs and a radius Rs, said targeting disk comprising;

a thin hemispherically shaped substrate, having an origin Os and a radius R equal to the combined length of Ro and Rs, said substrate spans from origin Os at r=(0 to R) at ø=(0 through 180°), and has a hemispherical perimeter and upper and lower surfaces that are planar and substantially parallel;

an alignment pattern visible from said upper surface of said substrate, said alignment pattern having an alignment origin Oa and a radius Ra, said radius Ra corresponding to radius Ro, and said alignment pattern spanning from r=(0 to Ra) at ø=(0 through 180°), said alignment pattern having a circular border that defines said alignment origin Oa at point (0,0); said alignment border extending from points r=Ra at ø=(0 through ø=180°); said alignment pattern providing a visual aid for aligning said alignment origin Oa under the central axis Co of the object ball;

an alignment edge forming a straight line from said alignment origin Oa and extending from point r=(0 to R) at ø=(0° and 180°), said alignment edge defining a first portion of said perimeter of said substrate, said alignment pattern being proximal said alignment edge;

a targeting edge forming a continuous arc extending from points r=R at ø=(0 through 180°) from said alignment origin Oa, said targeting edge defining a second portion of said perimeter of said substrate, said targeting indicium being located sufficiently close to said targeting edge to enable the striking ball to substantially simultaneously strike the object ball as it engages said targeting disk; and said targeting indicium visible from said upper surface of said substrate, said targeting indicium having a targeting origin Ot located at (R, 90°) and a radius Rd, said targeting indicium spanning from r=(0 to Rd) at ø=(0° through 360°), said targeting indicium having an indicium edge extending from points r=Rd at ø=(0° through 360°); said indicium edge forming a part of said alignment edge.

12. The billiards targeting disk of claim 11 and wherein the said targeting disk has a pointer aligned with said alignment origin Oa and said targeting origin Ot, said pointer forming a ray originating from said targeting origin Ot and extending towards said alignment origin Oa on a line of symmetry and having a length corresponding to Rs, said pointer being adapted to point at the target when said alignment origin is aligned with the central axis Co of the object ball.

13. The billiards targeting disk of claim 11 and wherein the object ball has a cross sectional area with a radius Rc just above the surface of the table, and wherein said alignment edge has a notch with a circular shaped edge with a radius of about Rc and an origin On, said origin On located at said alignment origin Oa, said circular shaped edge providing a continuous snugging area for engaging the object ball just above the surface of the table, said notch spanning from said origin On at r=(0 to Rc) at ø=(0 through 180°).

14. The billiards targeting disk of claim 11 and further comprising a targeting pattern visible from said upper surface of said substrate, said targeting pattern having a radius Rb corresponding to Rs, said targeting pattern having a circular targeting border defining said targeting origin Ot, said targeting origin Ot located at point (R, 90°), said targeting border extending from points r=Rb at ø=(180° through 360°), and said targeting pattern spanning from r=(0 to Rb) at ø=(180° through 360°).

* * * * *